US010261450B2

(12) United States Patent
Hasegawa et al.

(10) Patent No.: US 10,261,450 B2
(45) Date of Patent: Apr. 16, 2019

(54) IMAGE FORMING APPARATUS

(71) Applicants: Ryo Hasegawa, Kanagawa (JP); Kenji Honjoh, Kanagawa (JP); Atsushi Nagata, Kanagawa (JP); Haruki Nagata, Kanagawa (JP)

(72) Inventors: Ryo Hasegawa, Kanagawa (JP); Kenji Honjoh, Kanagawa (JP); Atsushi Nagata, Kanagawa (JP); Haruki Nagata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/014,085

(22) Filed: Jun. 21, 2018

(65) Prior Publication Data

US 2019/0025735 A1 Jan. 24, 2019

(30) Foreign Application Priority Data

Jul. 24, 2017 (JP) ..... 2017-142574

(51) Int. Cl.
*G03G 15/01* (2006.01)
*G03G 15/16* (2006.01)
*G03G 15/00* (2006.01)

(52) U.S. Cl.
CPC ..... *G03G 15/1615* (2013.01); *G03G 15/602* (2013.01); *G03G 15/605* (2013.01); *G03G 15/607* (2013.01)

(58) Field of Classification Search
CPC ..... G03G 15/505; G03G 15/0178; G03G 15/0189; G03G 15/1615; G03G 15/0136
USPC ..... 399/298, 299, 301, 302
See application file for complete search history.

(56) References Cited

U.S. PATENT DOCUMENTS

| | | | | |
|---|---|---|---|---|
| 7,058,327 | B2 * | 6/2006 | Isobe | G03G 15/0194 399/302 |
| 7,133,630 | B2 * | 11/2006 | Sakai | G03G 15/0131 399/301 |
| 7,424,255 | B2 * | 9/2008 | Sakai | G03G 15/5008 399/301 |
| 9,207,252 | B2 * | 12/2015 | Hamada et al. | G01P 3/68 |
| 2016/0103404 | A1 | 4/2016 | Hasegawa | |

FOREIGN PATENT DOCUMENTS

| | | |
|---|---|---|
| JP | 2006-171522 | 6/2006 |
| JP | 2014-059488 | 4/2014 |
| JP | 2016-075856 | 5/2016 |

* cited by examiner

*Primary Examiner* — William J Royer
(74) *Attorney, Agent, or Firm* — Harness, Dickey & Pierce, P.L.C.

(57) ABSTRACT

An image forming apparatus includes an apparatus body, a plurality of image bearers, an endless belt, a contact and separation mechanism to generate a first trajectory and a second trajectory of the endless belt, a sensor to detect an object on a surface of the endless belt, and a positioning mechanism to enable the sensor to detect the object in the first trajectory and the second trajectory of the endless belt. The positioning mechanism includes a stay to support the sensor, a first bracket, a second bracket, a first positioning portion attached to the apparatus body to position the sensor in a direction of rotation of the first bracket and the second bracket at a time of the first trajectory, and a second positioning portion attached to the second bracket to position the sensor in the direction of rotation of the first bracket at a time of the second trajectory.

10 Claims, 9 Drawing Sheets

IMAGE FORMING APPARATUS

CROSS-REFERENCE TO RELATED APPLICATION

This patent application is based on and claims priority pursuant to 35 U.S.C. § 119(a) to Japanese Patent Application No. 2017-142574, filed on Jul. 24, 2017, in the Japan Patent Office, the entire disclosure of which is hereby incorporated by reference herein.

BACKGROUND

Technical Field

Aspects of the present disclosure relate to an image forming apparatus.

Related Art

There are known tandem color image forming apparatuses of intermediate transfer type including an intermediate transfer belt and a plurality of photoconductor drums. The intermediate transfer belt is rotatably entrained around a plurality of support rollers, and the plurality of photoconductor drums are arranged side by side in contact with the intermediate transfer belt. In those image forming apparatuses, toner images on the plurality of photoconductor drums are transferred and deposited one on another to the intermediate transfer belt (primary transfer). The toner images on the intermediate transfer belt are transferred onto a transfer sheet at a time, thereby forming a multicolor toner image on the transfer sheet (secondary transfer).

Those image forming apparatuses include mechanisms that minimize color superimposition misalignment due to speed fluctuation of the intermediate transfer belt. That is, the intermediate transfer belt includes a scale having multiple marks aligned with a predetermined pitch in a direction of rotation of the intermediate transfer belt. A sensor detects the multiple marks of the scale, and a speed of the intermediate transfer belt is detected based on the time interval of the detection. Based on the detected result, a belt drive motor is feed-back controlled to minimize the speed fluctuation of the intermediate transfer belt.

The image forming apparatus is generally capable of forming images in a full-color mode using toners of four colors: black, cyan, magenta, and yellow, and a black mode using black toner. In addition, there is known an image forming apparatus that is capable of forming images in a special color mode using toner of a special color, or a combination of the full-color mode and the special color mode.

SUMMARY

According to an embodiment of this disclosure, an improved image forming apparatus includes an apparatus body, a plurality of image bearers to bear a toner image, an endless belt to contact at least one of the plurality of image bearers to form a transfer nip and rotate endlessly, a contact and separation mechanism to bring the endless belt into contact with the at least one of the plurality of image bearers and separate the endless belt from the at least one of the plurality of image bearers to generate a first trajectory of the endless belt and a second trajectory of the endless belt, a sensor to detect an object on a surface of the endless belt, and a positioning mechanism to enable the sensor to detect the object in the first trajectory and the second trajectory of the endless belt. The positioning mechanism includes a stay to support the sensor, a first bracket attached to each end of the stay, a second bracket rotatably supported by the apparatus body to rotatably support the first bracket, a first positioning portion attached to the apparatus body to position the sensor in a direction of rotation of the first bracket and the second bracket at a time of the first trajectory, and a second positioning portion attached to the second bracket to position the sensor in the direction of rotation of the first bracket at a time of the second trajectory.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
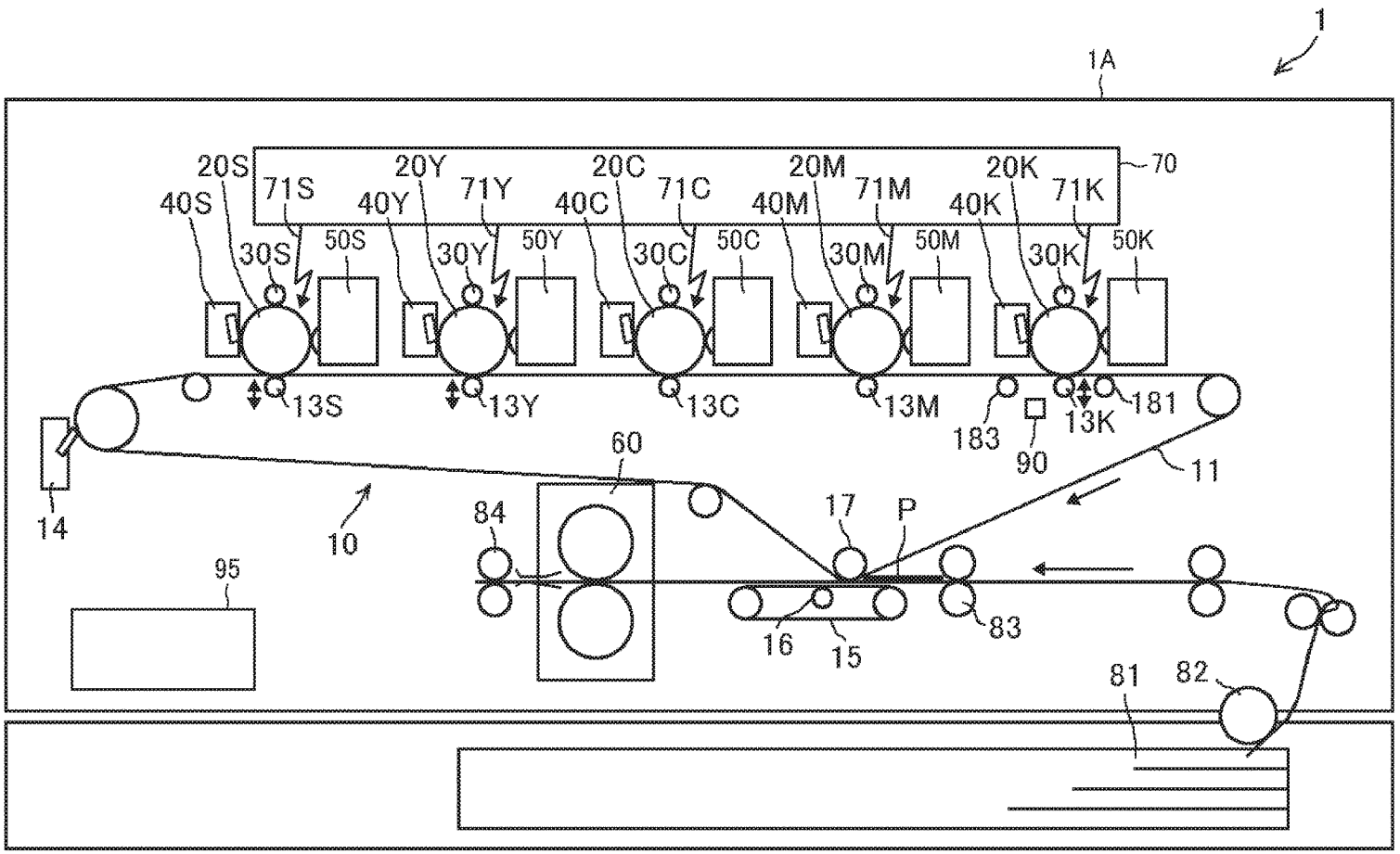
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise. In the description of embodiments below, components having the same function and configuration are given the same reference codes, and redundant descriptions thereof may be omitted. Components in the drawings may be partially omitted to facilitate understanding of the configurations. Note that the suffixes S, Y, C, M, and K attached to each reference numeral indicate only that components indicated thereby are used for forming a special color (white, clear, or the like), yellow, magenta, cyan, and black images, respectively, and hereinafter may be omitted when color discrimination is not necessary.

In the following embodiments, a sensor can detect an object on the surface of an intermediate transfer belt in two different trajectories of the intermediate transfer belt. The sensor is positioned by a positioning mechanism attached to an apparatus body in one of the two different trajectories.

FIG. 1 is a schematic view of an image forming apparatus according to an embodiment of the present disclosure.

As illustrated in FIG. 1, a color image forming apparatus 1 includes five image stations and a transfer device 10 including an endless-looped intermediate transfer belt 11 (i.e., an endless belt). The image stations include photoconductor drums 20S, 20Y, 20C, 20M, and 20K as image bearers. The image stations further include chargers 30S, 30Y, 30C, 30M, and 30K, developing devices 50S, 50Y, 50C, 50M, and 50K, and cleaners 40S, 40Y, 40C, 40M, and 40K around the photoconductor drums 20S, 20Y, 20C, 20M, and 20K, respectively.

Predetermined amount of toner stored in toner bottles are supplied to the developing devices 50S, 50Y, 50C, 50M, and 50K via conveyance paths, respectively.

The intermediate transfer belt 11 includes a scale (an object to be detected) having multiple marks aligned with a predetermined pitch in a direction of rotation of the intermediate transfer belt 11. A sensor 90 is disposed upstream from a primary transfer roller 13K and downstream from a driven roller 183. The sensor 90 detects the multiple marks of the scale and obtains a speed of the intermediate transfer belt 11 based on a time interval of the detection. A controller 95 included in the image forming apparatus 1 calculates the speed of the intermediate transfer belt 11 based on the detection result by the sensor 90. The sensor 90 is disposed upstream from the photoconductor drum 20K disposed extreme downstream in the direction of rotation of the intermediate transfer belt 11.

The driven roller 183 forms an entry nip between the primary transfer roller 13K and the photoconductor drum 20K and keeps the surface of the intermediate transfer belt 11 to be detected by the sensor 90 level.

An image forming operation is described below. The chargers 30S, 30Y, 30C, 30M, and 30K uniformly charge the photoconductor drums 20S, 20Y, 20C, 20M, and 20K, respectively. Then, exposure device 70 irradiates the photoconductor drums 20S, 20Y, 20C, 20M, and 20K with laser beams 71S, 71Y, 71C, 71M, and 71K, thereby forming electrostatic latent images of the special color (S), yellow (Y), cyan (C), magenta (M), and black (K) on the surfaces of the photoconductor drums 20S, 20Y, 20C, 20M, and 20K, respectively.

The developing devices 50S, 50Y, 50C, 50M, and 50K develop the electrostatic latent images to form toner images of the special color (S), yellow (Y), cyan (C), magenta (M), and black (K) on the photoconductor drums 20S, 20Y, 20C, 20M, and 20K, respectively. Then, voltages are applied to primary transfer rollers 13S, 13Y, 13C, 13M, and 13K, and the toner images on the photoconductor drums 20S, 20Y, 20C, 20M, and 20K are primarily transferred and deposited one on another onto the intermediate transfer belt 11.

Note that, image formations are executed sequentially in the image stations from the upstream side to the downstream side in the direction of rotation of the intermediate transfer belt 11 at different timings so that the respective color toner images are transferred to an identical position on the intermediate transfer belt 11. A contact portion between an outer peripheral surface of the intermediate transfer belt 11 and the photoconductor drum 20 as the image bearer is referred to as a transfer nip.

A sheet feeding roller 82 feeds a recording sheet P as a recording medium from a sheet tray 81. A sheet sensor detects the position of the recording sheet P when the tip of the recording sheet P reaches a pair of registration rollers 83. The pair of registration rollers 83 conveys the recording sheet P to the secondary transfer nip between a secondary transfer belt 15 and the intermediate transfer belt 11 timed to coincide with image formation by the detection signal from the sheet sensor.

Then, the multicolor toner image on the intermediate transfer belt 11 is transferred onto the recording sheet P by the effects of the potential difference between a secondary-transfer backup roller 17 and a secondary transfer roller 16.

The recording sheet P bearing the toner image transferred thereon is conveyed toward a fixing device 60 horizontally. The fixing device 60 fixes the multicolor toner image on the recording sheet P by heat and pressure, and the recording sheet P is ejected by a pair of sheet ejection rollers 84. Then, the image formation is completed.

The cleaners 40S, 40Y, 40C, 40M, and 40K remove residual toner on the photoconductor drums 20S, 20Y, 20C, 20M, and 20K, respectively. Subsequently, bias, in which direct current is superimposed with alternating current component, is applied to the chargers 30S, 30Y, 30C, 30M, and 30K, and the chargers 30S, 30Y, 30C, 30M, and 30K simultaneously discharge and charge the photoconductor drums 20S, 20Y, 20C, 20M, and 20K in preparation for the next image formation.

A belt cleaner 14 removes residual toner remaining on the intermediate transfer belt 11 in preparation for next image formation.

The above-described image forming operation is in a full-color and special color (FCS) mode in which all toners: the special color (S), yellow (Y), cyan (C), magenta (M), and black (K) toners are used. In addition, there are a full-color (FC) mode in which yellow (Y), cyan (C), magenta (M), and black (K) toners are used; a black (K) mode in which only black (K) toner is used; and a special color (S)-single mode in which only the special color (S) toner is used.

Contact-separation states of the photoconductor drum 20 and the intermediate transfer belt 11 are different from each other in respective image forming modes. TABLE 1 illustrates the contact-separation states of the photoconductor drum 20 and the intermediate transfer belt 11 in the respective image forming modes.

TABLE 1

| | | CONTACT-SEPARATION STATE | | |
|---|---|---|---|---|
| | | K | Y C, and M | S |
| MODE | K (black) | CONTACT | SEPARATE | SEPARATE |
| | FC (full color) | CONTACT | CONTACT | SEPARATE |
| | FCS (full color + special color) | CONTACT | CONTACT | CONTACT |
| | S-single (special color alone) | SEPARATE | SEPARATE | CONTACT |

Three contact and separation mechanisms for K, color, and S color bring the intermediate transfer belt 11 in contact with the respective photoconductor drums 20 and separate the intermediate transfer belt 11 from the respective photoconductor drums 20. That is, a K contact and separation mechanism performs the contact and separation operation of the photoconductor drum 20K, a color contact and separation mechanism performs the contact and separation operation of the photoconductor drums 20Y, 20C, and 20M, and an S contact and separation mechanism performs the contact and separation operation of the photoconductor drum 20S. Each of the contact and separation mechanisms are independently operated so that the above-described image forming modes can be executed as illustrated in TABLE 1. In other words, the K contact and separation mechanism brings the intermediate transfer belt 11 in contact with the photoconductor drum 20K in the K mode, the K contact and separation mechanism and the color contact and separation mechanism bring the intermediate transfer belt 11 in contact with the photoconductor drums 20Y, 20C, 20M, and 20K in the FC mode, the K contact and separation mechanism, the color contact and separation mechanism, and the S contact and separation mechanism bring the intermediate transfer belt 11 in contact with the photoconductor drums 20S, 20Y, 20C, 20M, and 20K in the FCS mode, and the S contact and separation mechanism brings the intermediate transfer belt 11 in contact with the photoconductor drum 20S in the S-single mode.

Further, each primary transfer roller 13 separates from the photoconductor drum 20 to prevent abrasion of the photoconductor drum 20 and the intermediate transfer belt 11 when that primary transfer roller 13 is not used.

The primary transfer roller 13K is disposed in contact with the photoconductor drum 20K in the K mode, the FC mode, and the FCS mode. Further, driven rollers 181 and 183 are shifted upward and contact the intermediate transfer belt 11 (a contact position). On the other hand, driven rollers 181 and 183 are shifted downward to separate the primary transfer roller 13K from the photoconductor drum 20K in the S-single mode (a separation position). For this reason, the primary transfer roller 13K and the driven rollers 181 and 183 are shifted between the contact position and the separation position by the same K contact and separation mechanism.

In the color image forming apparatus 1 according to the present embodiment, the image station for the special color (the photoconductor drum 20S) including the primary transfer roller 13S is disposed lower than the other stations with a certain offset in a vertical direction to the intermediate transfer belt 11. This is for preventing the photoconductor drums 20Y, 20C, 20M, and 20K other than the special color photoconductor drum 20S from contacting the intermediate transfer belt 11 when images are formed by only the image station for the special color (S-single mode). According to the present embodiment, for example, an amount of offset is approximately 3 mm. Therefore, the belt track (the trajectory) of the intermediate transfer belt 11 is different between the S-single mode and the other modes (the FCS mode, the K mode, and the FC mode).

As in the FCS mode, the K mode, or the FC mode, the belt track (the trajectory) of the intermediate transfer belt 11 in which the photoconductor drums 20 other than the photoconductor drum 20S disposed at an extreme upstream position are in contact with the intermediate transfer belt 11 is referred to as a first belt track.

On the other hand, as in the S-single mode, the belt track (the trajectory) of the intermediate transfer belt 11 in which only the photoconductor drum 20S disposed at the extreme upstream position is in contact with the intermediate transfer belt 11 is referred to as a second belt track.

TABLE 2 illustrates a relation between the image forming mode and the belt track of the intermediate transfer belt 11.

TABLE 2

| | | BELT TRACK |
|---|---|---|
| MODE | K | FIRST BELT TRACK |
| | FC | FIRST BELT TRACK |
| | FCS | FIRST BELT TRACK |
| | S-single | SECOND BELT TRACK |

The three contact and separation mechanisms described above bring the intermediate transfer belt 11 in contact with the photoconductor drums 20 and separate the intermediate transfer belt 11 from the photoconductor drums 20, thereby generating the first belt track and the second belt tack, respectively.

Figure 2:
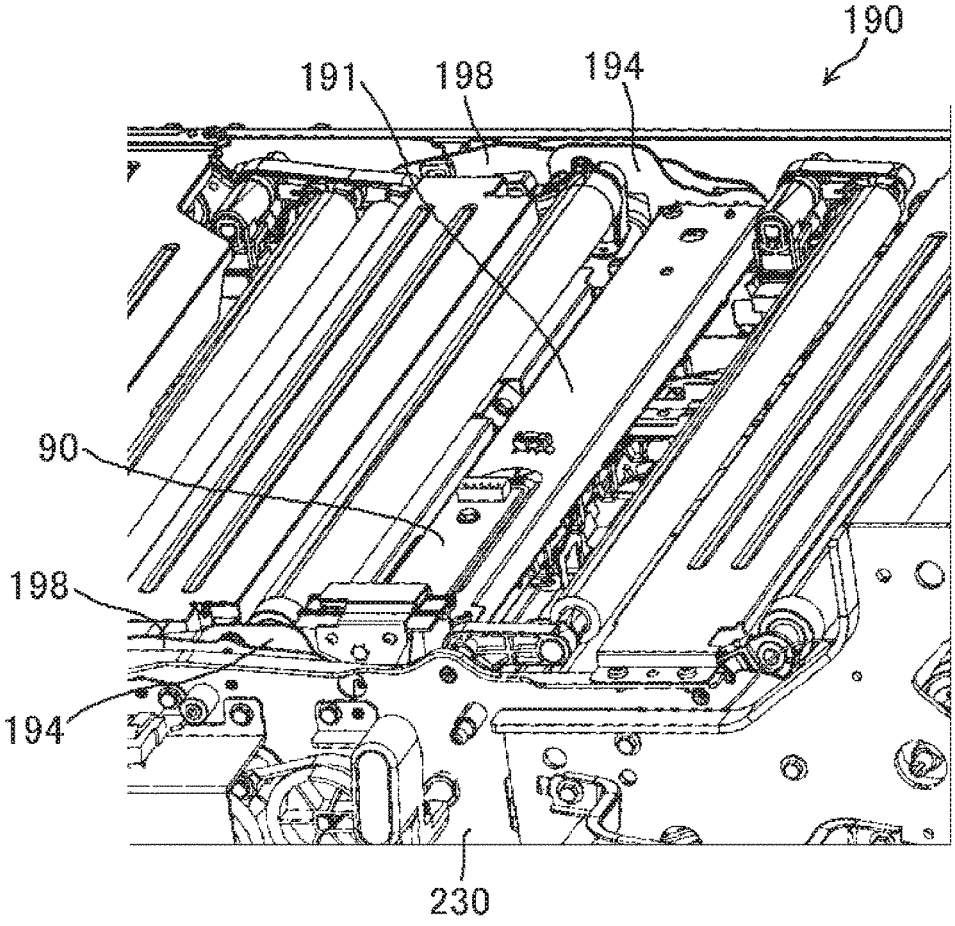
FIG. 2 is a perspective view of a sensor and a positioning mechanism according to an embodiment of the present disclosure.

FIG. 2 is a perspective view of the sensor 90 and a positioning mechanism 190 according to the present embodiment. As illustrated in FIG. 2, the positioning mechanism 190 includes a stay 191 on which the sensor 90 is disposed, inner brackets 194 disposed at both ends of the stay 191 in a longitudinal direction of the stay 191, and outer brackets 198 to rotatably support the inner brackets 194. Side plates 230, only one of which is visible in the view illustrated in FIG. 2, rotatably support the outer brackets 198. Note that the inner bracket 194 is an example of a first bracket, and the outer bracket 198 is an example of a second bracket.

Since the positioning mechanism 190 has a two-stage configuration with two types of brackets, the sensor 90 can be held parallel to the intermediate transfer belt 11. In the following embodiments, the positioning accuracy of the sensor 90 can be secured by the positioning mechanism 190 in two different belt tracks (the first belt track and the second belt track).

First, the operation of the positioning mechanism 190 in the FCS mode (the first belt track) is described.

Figure 3:
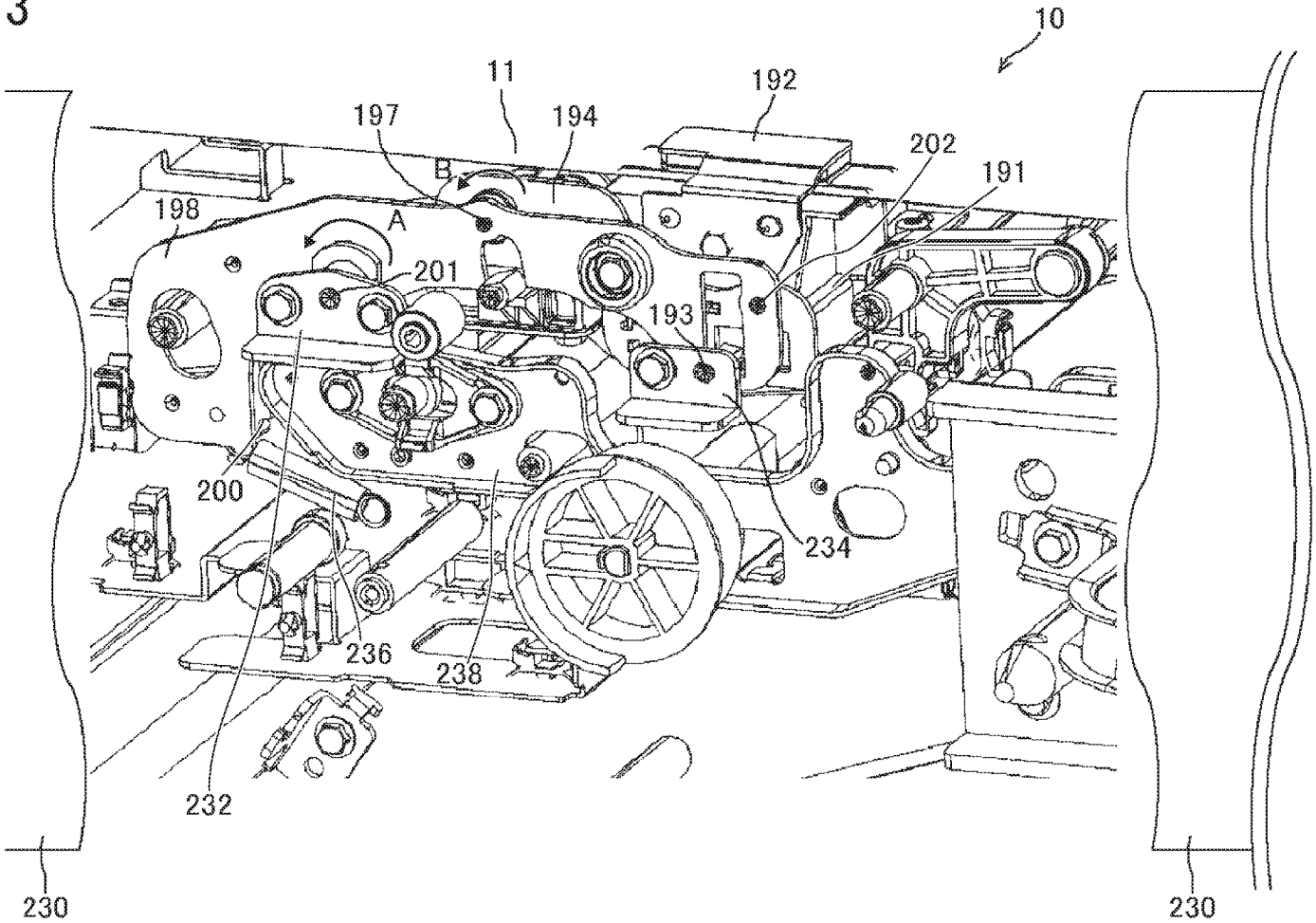
FIG. 3 is a perspective view of the positioning mechanism and environs thereof in FCS mode according to an embodiment of the present disclosure.
Figure 4:
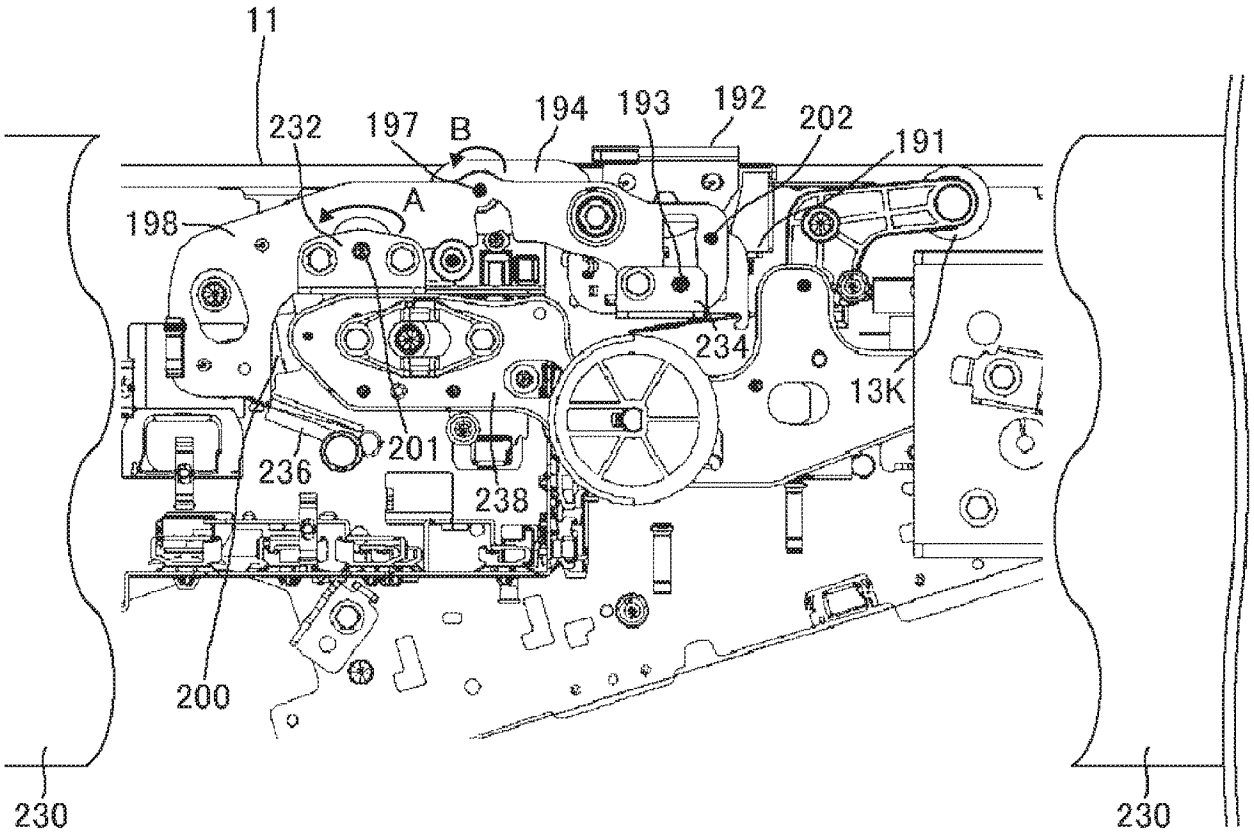
FIG. 4 is a side view of the positioning mechanism and environs thereof in FCS mode according to an embodiment of the present disclosure.
Figure 5:
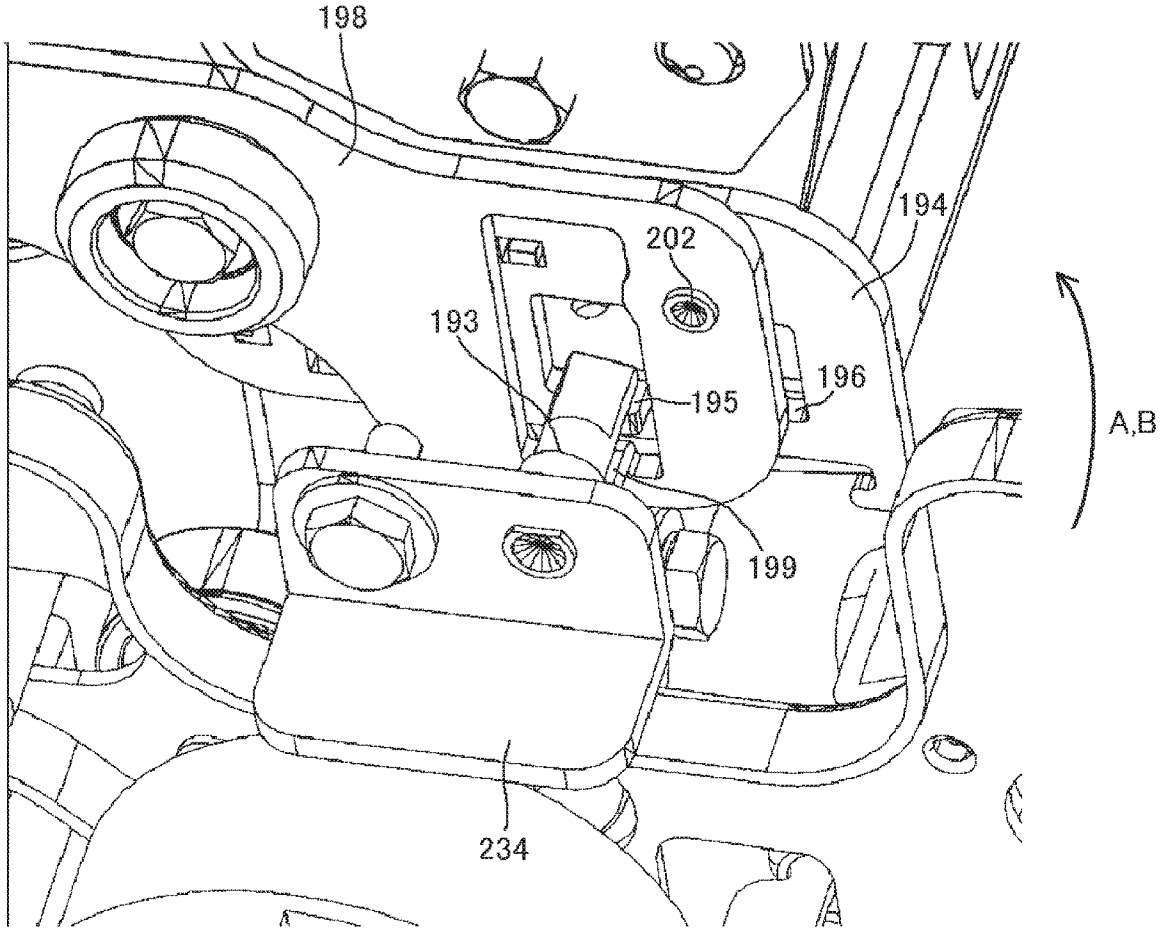
FIG. 5 is an enlarged view of the positioning mechanism in FCS mode according to an embodiment of the present disclosure.

FIG. 3 is a perspective view of the positioning mechanism 190 and environs thereof in the FCS mode according to the present embodiment, and FIG. 4 is a side view of the positioning mechanism 190 and environs thereof in the FCS mode according to the present embodiment. FIG. 5 is a schematic enlarged view of the positioning mechanism 190 according to the present embodiment in the FCS mode according to the present embodiment.

The side plate 230 constitutes a part of an apparatus body 1A of the color image forming apparatus 1 (a housing of the transfer device 10) and serves as a positioning basis of components or devices attached to the side plate 230. For the sake of simplicity, the side plate 230 is illustrated in the drawings with a most part thereof omitted.

As illustrated in FIGS. 3 and 4, the positioning mechanism 190 including the sensor 90 is incorporated in the transfer device 10. The sensor 90 detects the scale marks attached to an inner surface of the intermediate transfer belt 11. If the intermediate transfer belt 11 waves, the sensor 90 does not detect the scale marks successfully. Therefore, a pressing member 192 for pressing the intermediate transfer belt 11 from above is attached to the transfer device 10.

A first angled plate 232 including a stud 201 and a second angled plate 234 including a stud 193 are attached to the side plate 230.

The outer bracket 198 is rotatably supported around the stud 201 of the first angled plate 232 as a first rotational fulcrum relative to the side plate 230. Further, the outer bracket 198 is urged by a spring 236 attached to an end of the outer bracket 198 below the stud 201 counterclockwise as indicated by Arrow A in FIGS. 3 and 4. Accordingly, as illustrated in FIG. 5, a portion 199 to be positioned of the outer bracket 198 contacts the stud 193 of the second angled plate 234, thereby being positioned in a rotational direction of the outer bracket 198. The stud 193 of the second angled plate 234 is referred to as a first positioning portion.

Referring back to FIGS. 3 and 4, the description is continued. The inner bracket 194 is rotatably supported around a stud 197 attached to the outer bracket 198 as a second rotational fulcrum relative to the outer bracket 198. Further, the inner bracket 194 is urged by a spring attached to an end of the inner bracket 194 counterclockwise as indicated by Arrow B in FIGS. 3 and 4. Accordingly, as illustrated in FIG. 5, a portion 195 to be positioned of the inner bracket 194 contacts the stud 193 of the second angled plate 234, thereby being positioned in a rotational direction of the inner bracket 194.

As described above, the studs 201 and 193 are secured to the side plate 230 via the first angled plate 232 and the second angled plate 234, respectively. Therefore, position accuracy is maintained properly. That is, the sensor 90 is positioned with high accuracy in the FCS mode. Such a configuration reduces speed detection error of the intermediate transfer belt 11, thus improving image quality. The above description is also the same in the FC mode and the K mode.

Next, the operation of the positioning mechanism 190 in the S-single mode (the second belt track) is described. A configuration of a slider 238 is described as a supplement before the description of the operation of the positioning mechanism 190.

Figure 6:
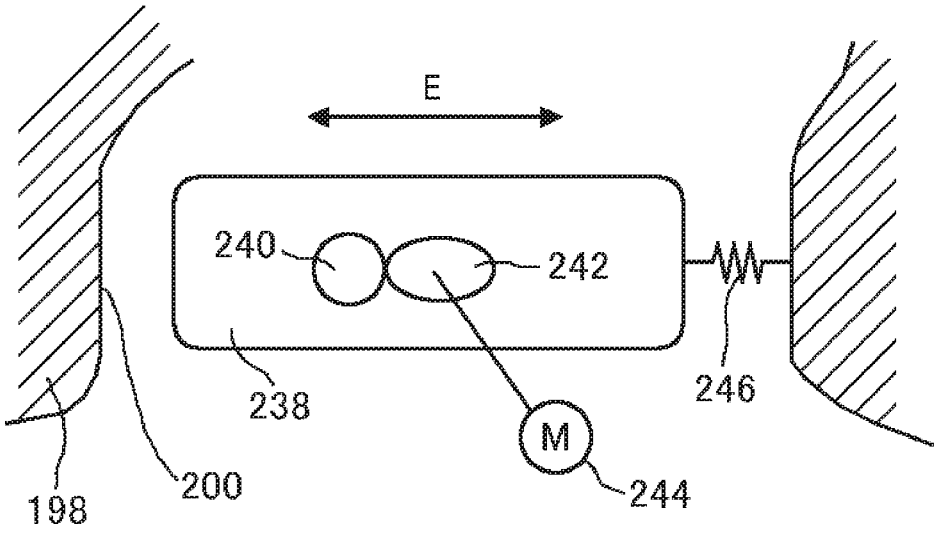
FIG. 6 is a schematic view of a slider according to an embodiment of the present disclosure.

FIG. 6 is a schematic view of the slider 238 according to the present embodiment. The slider 238 disposed below the outer bracket 198 is movable in a left-right direction in FIGS. 3 and 4.

As illustrated in FIG. 6, a stud 240 attached to the slider 238 is disposed in contact with a cam 242 rotatably supported by the housing of the transfer device 10). The cam 242 is coupled to a motor 244. An end of the slider 238 receives elastic power of a spring 246 attached to the housing of the transfer device 10.

As the motor 244 is driven and the cam 242 rotates, the slider 238 presses against a contact surface 200 of the outer bracket 198. On the other hand, without the drive force of the motor 244, the slider 238 is urged in a direction away from the contact surface 200 of the outer bracket 198 by the spring 246.

Figure 7:
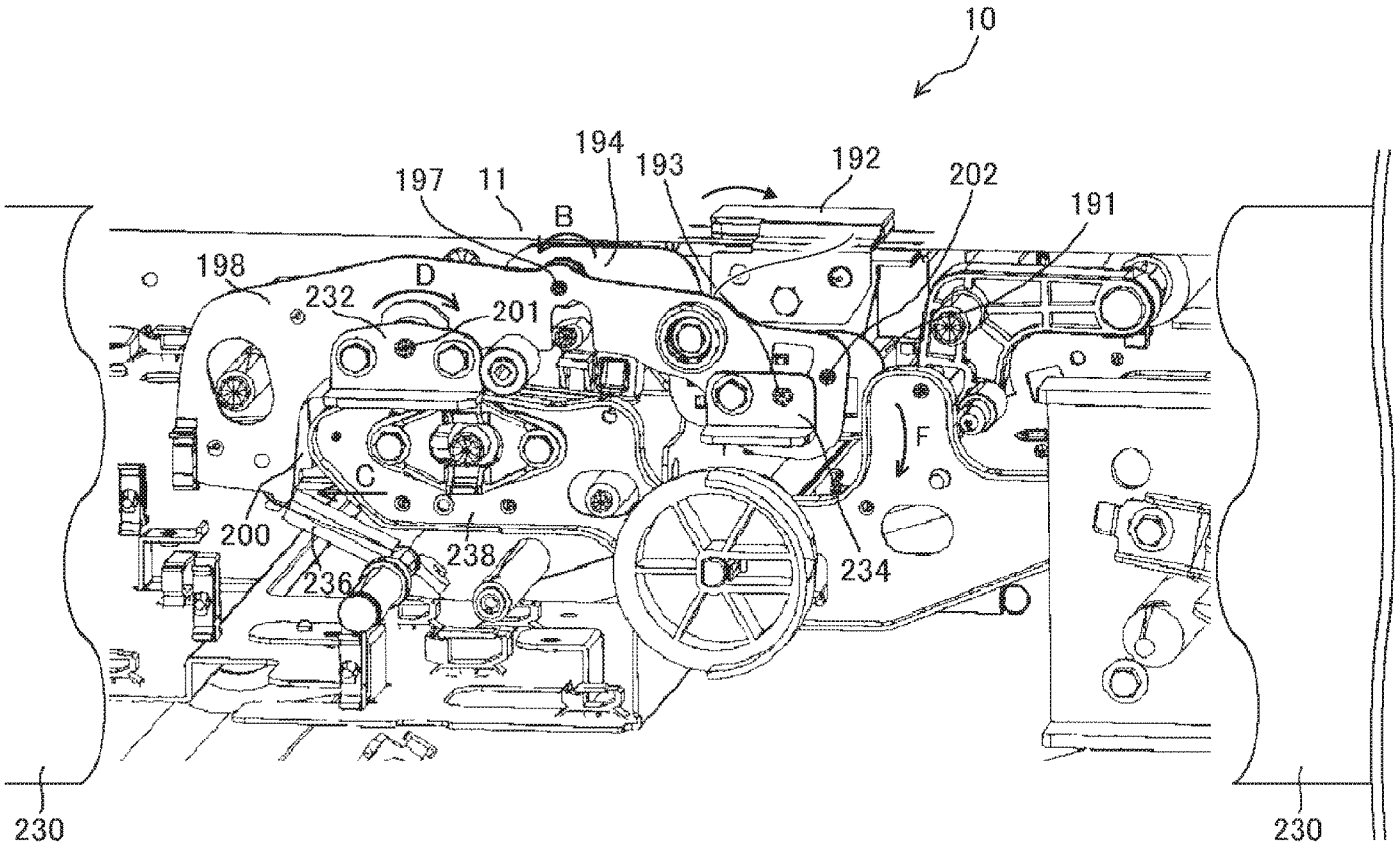
FIG. 7 is a perspective view of the positioning mechanism and environs thereof in S-single mode according to an embodiment of the present disclosure.
Figure 8:
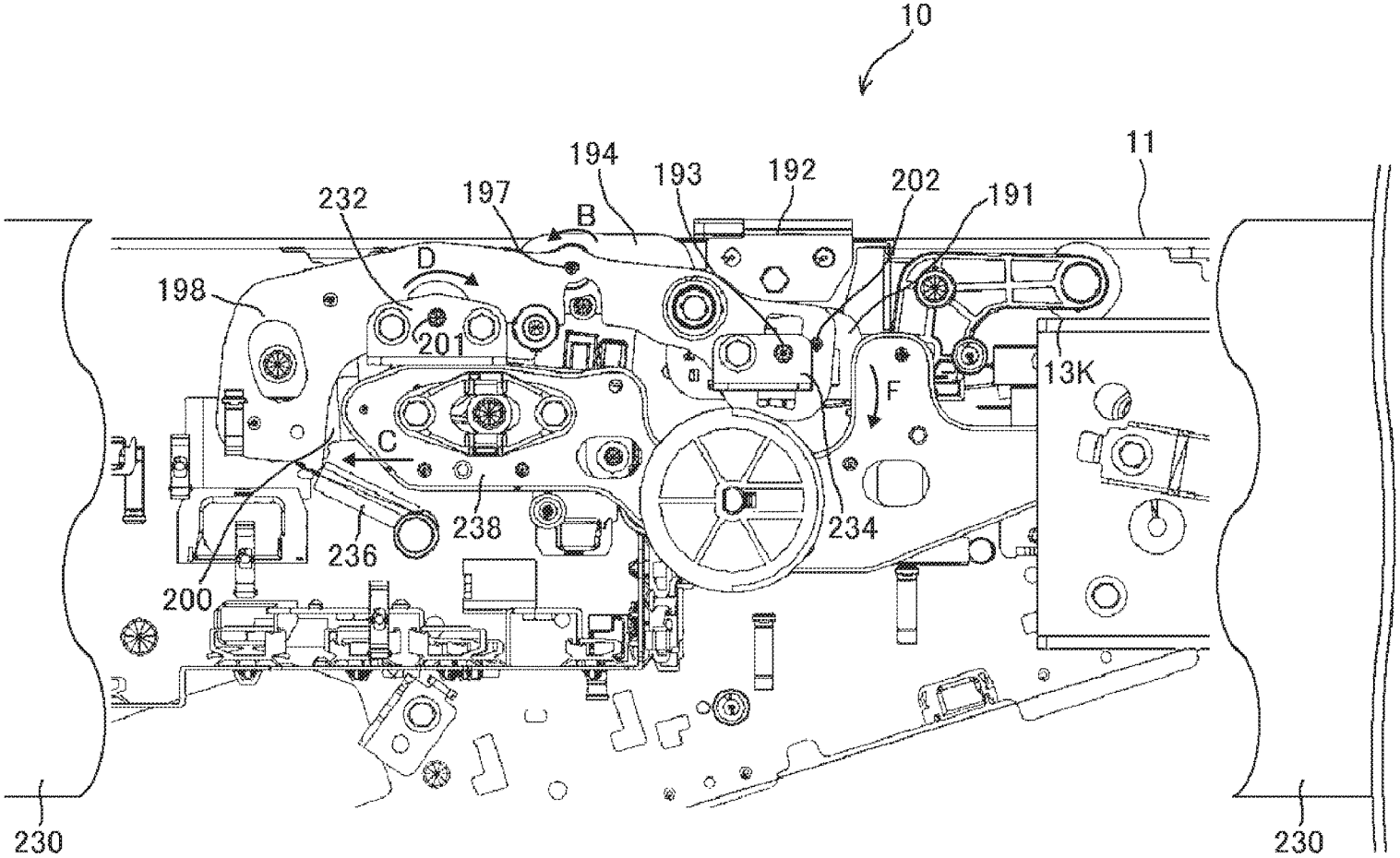
FIG. 8 is a side view of the positioning mechanism and environs thereof in S-single mode according to an embodiment of the present disclosure.
Figure 9:
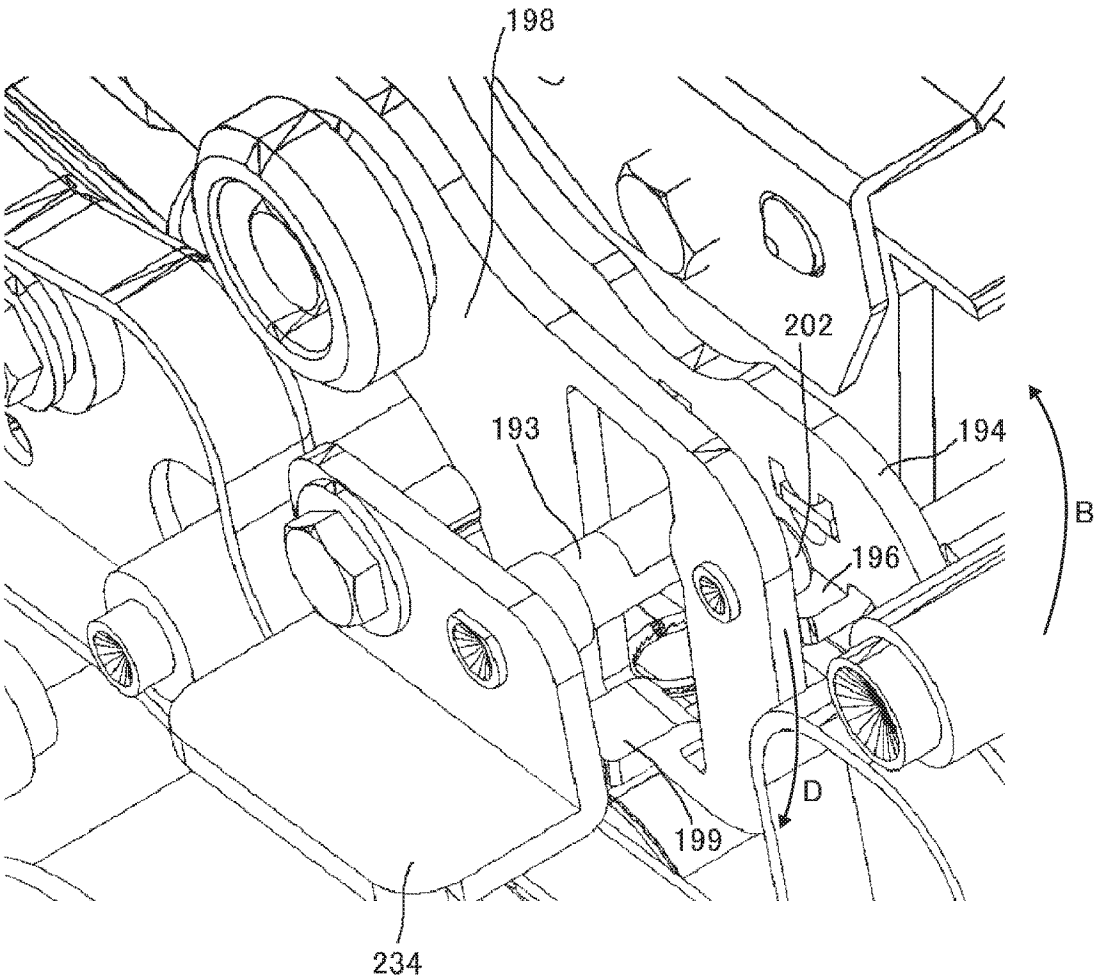
FIG. 9 is an enlarged perspective view of the positioning mechanism in S-single mode according to an embodiment of the present disclosure.

FIG. 7 is a perspective view of the positioning mechanism 190 and environs thereof in the S-single mode according to the present embodiment, and FIG. 8 is a side view of the positioning mechanism 190 and environs thereof in the S-single mode according to the present embodiment. FIG. 9 is a schematic enlarged perspective view of the positioning mechanism 190 according to the present embodiment in the S-single mode according to the present embodiment.

Identical reference numerals are assigned to components illustrated in FIGS. 7 to 9 that are identical to the components illustrated in FIGS. 3 to 5 and description of the identical components is omitted. For the sake of simplicity, an illustration of part of the side plate 230 is omitted in FIGS. 7 and 8.

In the S-single mode, as illustrated in FIG. 6, as the motor 244 is driven and the cam 242 presses the stud 240 to the left as indicated by Arrow C in FIGS. 7 and 8, the slider 238 contacts and presses the contact surface 200 of the outer bracket 198. The outer bracket 198 rotates clockwise as indicated by Arrow D in FIGS. 7 and 8 against elastic power of the spring 236, and an end of the outer bracket 198 moves downward.

As the end of the outer bracket 198 moves downward, the inner bracket 194 also moves downward as indicated by Arrow F in FIGS. 7 and 8. However, since the inner bracket 194 is urged by the spring, the inner bracket 194 rotates counterclockwise as indicated by Arrow B in FIGS. 7 and 8. around the stud 197. Accordingly, as illustrated FIG. 9, a portion 196 to be positioned of the inner bracket 194 contacts a stud 202 of the outer bracket 198, thereby being positioned in the rotational direction of the inner bracket 194. The stud 202 attached to the outer bracket 198 is referred to as a second positioning portion.

In the S-single mode (the second belt track), the inner bracket 194 is positioned in the rotational direction of the inner bracket 194 by the stud 202 attached to the outer bracket 198. Since the outer bracket 198 moves (pivots), position accuracy in the S-single mode (the second belt track) is lower than that in the FCS mode (the first belt track), but the sensor 90 can be positioned with this configuration. Therefore, the sensor 90 can detect the speed of the intermediate transfer belt 11 in the S-single mode (the second belt track).

As described above, the positioning mechanism 190 of the image forming apparatus 1 according to the present embodiment has the two-stage configuration in which two brackets supporting the stay 191 (i.e., the inner bracket 194 and the outer bracket 198) are coupled to each other at different rotational fulcrums, and the respective brackets are positioned by two different positioning portions. Therefore, the sensor 90 can be positioned parallel to the intermediate transfer belt 11 in two different belt tracks. In particular, in the FC mode, the FCS mode, and the K mode, the sensor 90 can be positioned with high accuracy by the first positioning portion attached to the side plate 230. On the other hand, in the S-single mode, the sensor 90 can be positioned by the second positioning portion attached to the outer bracket 198 and can detect the scale marks.

The inner bracket 194 is rotatably supported around the second rotational fulcrum (the stud 197) of the outer bracket 198, and a distance from the second rotational fulcrum to the second positioning portion (the stud 202) is longer than a distance from the second rotational fulcrum to the first positioning portion (the stud 193). With this configuration, the sensor 90 can be positioned parallel to the intermediate transfer belt 11 in two different belt tracks.

The outer bracket 198 is rotatably supported around the first rotational fulcrum (the stud 201) attached to the apparatus body 1A via the side plate 230. The first rotational fulcrum can also serve as a rotational fulcrum of the driven roller 183 disposed upstream from the primary transfer roller 13K in the direction of rotation of the intermediate transfer belt 11. This configuration reduces the number of components and saves space.

A single contact and separation mechanism can move the two driven rollers 181 and 183, the primary transfer roller 13K disposed between the two driven rollers 181 and 183, and the positioning mechanism 190 all together. This configuration reduces the number of components and saves space.

Numerous additional modifications to the above-described embodiment and variations are possible. It is therefore to be understood that, within the scope of the appended claims, the disclosure of this patent specification may be practiced otherwise than as specifically described herein. For example, in the above-described embodiment, as illustrated in FIG. 1, the photoconductor drums 20 of the special color, yellow, magenta, cyan, and black are arranged from upstream in the direction of rotation of the intermediate transfer belt 11 in this order, but not limited to this order. The order can be changed appropriately according to the purpose of use.

What is claimed is:

1. An image forming apparatus comprising:

an apparatus body;

a plurality of image bearers to bear a toner image;

an endless belt rotatable to contact at least one of the plurality of image bearers to form a transfer nip;

a contact and separation mechanism to bring the endless belt into contact with the at least one of the plurality of image bearers and separate the endless belt from the at least one of the plurality of image bearers to generate a first trajectory of the endless belt and a second trajectory of the endless belt;

a sensor to detect an object on a surface of the endless belt; and a positioning mechanism to enable the sensor to detect the object in the first trajectory and the second trajectory of the endless belt, the positioning mechanism including:

a stay to support the sensor;

a first bracket attached to each end of the stay;

a second bracket rotatably supported by the apparatus body to rotatably support the first bracket;

a first positioning portion attached to the apparatus body to position the sensor in a direction of rotation of the first bracket and the second bracket when the endless belt moves along the first trajectory; and a second positioning portion attached to the second bracket to position the sensor in the direction of rotation of the first bracket when the endless belt moves along the second trajectory.

2. The image forming apparatus according to claim 1, wherein the sensor and the positioning mechanism are disposed upstream from an extreme downstream image bearer of the plurality of image bearers in a direction of rotation of the endless belt.

3. The image forming apparatus according to claim 1 further comprising a pressing member to press another surface of the endless belt opposite to the surface with the object.

4. The image forming apparatus according to claim 1, wherein an extreme upstream image bearer of the plurality of image bearers in a direction of rotation of the endless belt is disposed lower in a vertical direction than image bearers of the plurality of image bearers other than the extreme upstream image bearer.

5. The image forming apparatus according to claim 1, wherein the first bracket is rotatably supported around a second rotational fulcrum attached to the second bracket, and a distance from the second rotational fulcrum to the second positioning portion is longer than a distance from the second rotational fulcrum to the first positioning portion.

6. The image forming apparatus according to claim 1, wherein the contact and separation mechanism moves two driven rollers disposed upstream and downstream from the positioning mechanism, a primary transfer roller disposed between the two driven rollers, the sensor, and the positioning mechanism.

7. The image forming apparatus according to claim 6, wherein the second bracket is rotatably supported around a first rotational fulcrum attached to the apparatus body, and a driven roller of the two driven rollers disposed upstream in a direction of rotation of the endless belt pivots around the first rotational fulcrum.

8. The image forming apparatus according to claim 1, wherein the second trajectory is a trajectory along which the endless belt moves when only an extreme upstream image bearer of the plurality of image bearers is used for image formation, and the first trajectory is a trajectory other than the second trajectory.

9. The image forming apparatus according to claim 1, wherein the image forming apparatus has a black (K) mode to use only black toner; a full-color (FC) mode to use cyan toner, magenta toner, yellow toner, and black toner; a full-color and special color (FCS) mode to use cyan toner, magenta toner, yellow toner, black toner, and special color toner; and a special color (S-single) mode to use only special color toner, wherein the contact and separation mechanism includes a K contact and separation mechanism to perform a contact and separation operation of a black image bearer of the plurality of image bearers, a color contact and separation mechanism to perform a contact and separation operation of yellow, cyan, and magenta image bearers of the plurality of image bearers, and a special color (S) contact and separation mechanism to perform a contact and separation operation of a special color image bearer of the plurality of image bearers.

10. The image forming apparatus according to claim 9, wherein the K contact and separation mechanism, the color contact and separation mechanism, and the S contact and separation mechanism are independent mechanisms, respectively.

* * * * *